US007824214B2

(12) United States Patent
Paynter

(10) Patent No.: US 7,824,214 B2
(45) Date of Patent: Nov. 2, 2010

(54) COUPLING NUT WITH CABLE JACKET RETENTION

(75) Inventor: Jeffrey Paynter, Momence, IL (US)

(73) Assignee: CommScope, Inc. of North Carolina, Hickory, NC (US)

( * ) Notice: Subject to any disclaimer, the term of this patent is extended or adjusted under 35 U.S.C. 154(b) by 269 days.

(21) Appl. No.: 12/164,854

(22) Filed: Jun. 30, 2008

(65) Prior Publication Data

US 2009/0325420 A1 Dec. 31, 2009

(51) Int. Cl.
*H01R 9/05* (2006.01)

(52) U.S. Cl. ..... 439/578

(58) Field of Classification Search ..... 439/578–585, 439/675, 63

See application file for complete search history.

(56) References Cited

U.S. PATENT DOCUMENTS 3,103,548 A 9/1963 Concelman
3,915,539 A 10/1975 Collins
4,557,546 A 12/1985 Dreyer
5,795,188 A 8/1998 Harwath
7,011,546 B2 3/2006 Vaccaro
7,335,059 B2 2/2008 Vaccaro
7,347,727 B2 * 3/2008 Wlos et al. ..... 439/578
7,390,027 B2 * 6/2008 Kiely ..... 285/151.1
7,588,460 B2 * 9/2009 Malloy et al. ..... 439/578

* cited by examiner

*Primary Examiner*—Edwin A. Leon
(74) *Attorney, Agent, or Firm*—Babcock IP, PLLC

(57) ABSTRACT

A coupling nut for an electrical connector connectable to an electrical cable having an outer conductor surrounded by a jacket. The coupling nut formed as a cylindrical body with a bore extending between a cable end and a connector end. An annular wedge groove in the bore sidewall proximate the cable end with an angled wedge surface extending from the bore sidewall at a cable end side to a bottom diameter within the wedge groove. A snap ring retained in the wedge groove, an inner surface of the snap ring provided with a gripping feature.

20 Claims, 12 Drawing Sheets

COUPLING NUT WITH CABLE JACKET RETENTION

BACKGROUND

1. Field of the Invention

This invention relates to electrical cable connectors. More particularly, the invention relates to a coupling nut for a coaxial cable connector that has a jacket retention capability.

2. Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling nut. Representative of this technology is U.S. Pat. No. 5,795,188 issued Aug. 18, 1998 to Harwath, also owned by applicant, CommScope, Inc. of North Carolina.

The coupling nut may be provided with an extended body to align and support the cable coaxially within the coupling nut bore and also to provide space for an environmental seal between the coupling nut and the outer jacket of the coaxial cable. The coupling nut may be shortened to minimize connector weight and materials costs. When the coupling nut is shortened, alignment with and retention to the coaxial cable becomes increasingly important.

Prior shortened coupling nuts have applied an internal thread that engages and retains the cable jacket during connector assembly. The quality of retention between the coupling nut and the cable jacket is dependent upon the tolerances of the cable outer conductor and jacket. The threads rotationally interlock the coupling nut with the cable and consume a large longitudinal portion of the coupling nut, reducing the space available for an environmental seal between the coupling nut and the jacket. Representative of this technology is U.S. Pat. No. 7,335,059 issued Feb. 26, 2008 to Vaccaro, also owned by applicant, CommScope, Inc. of North Carolina.

Competition in the coaxial cable connector market has focused attention on improving electrical performance and minimization of overall costs, including materials costs, training requirements for installation personnel, reduction of dedicated installation tooling and the total number of required installation steps and or operations.

Therefore, it is an object of the invention to provide a coupling nut that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
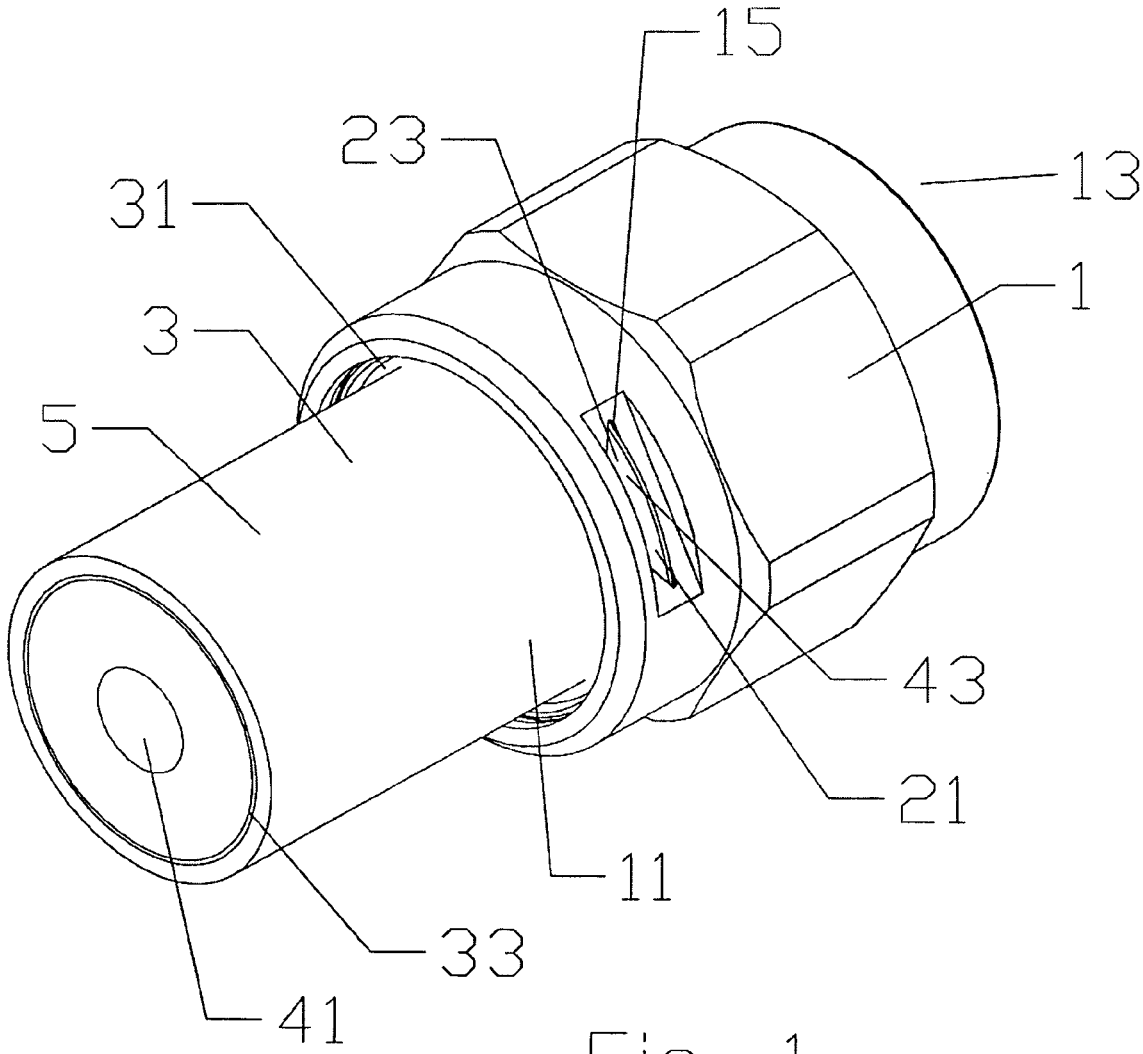
FIG. 1 is a schematic isometric rear view of a first exemplary embodiment of a coupling nut mounted on a portion of coaxial cable.

The inventor has analyzed available coupling nuts and recognized that the rotational interlock between the coupling nut and the coaxial cable created by application of internal threading to the coupling nut that engages the cable jacket often damages the inner conductor. Metal shavings may be generated as the inner conductor repeatedly rotates within the connector body during threading of the coupling nut upon the connector body to clamp the leading edge of the outer conductor. These metal shavings are a source of inter-modulation distortion (IMD), a significant factor of the cable and connector interconnection electrical performance. The threaded engagement between the jacket and the coupling nut adds an additional requirement for precision during cable end preparation and an extra assembly step, the threading of the coupling nut onto the jacket. Further, the threaded interconnection obtained has limited retention strength due to required allowances for the variance observed with respect to the jacket dimensions, especially between cables from different manufacturers.

As shown in FIGS. 1-9, a coupling nut 1 according to a first exemplary embodiment of the invention eliminates the rotational interlock between the coupling nut 1 and the jacket 3 and thus the cable 5, while also providing a connection between the jacket 3 and coupling nut 1 with an increasing retention force as a withdrawal force on the cable 5 is increased, thereby securing and maintaining the cable 5 coaxial with the coupling nut 1. The coupling nut 1 has a cylindrical body 7 with a bore 9 extending between a cable end 11 and a connector end 13. Depending upon the selected connector interface, the coupling nut 1 may be provided with a thread 10 in the bore 9 side wall 17 proximate the connector end 12.

One skilled in the art will appreciate that the cable end 11 and the connector end 13 and also the cable end 11 side and the connector end 13 side are descriptors used herein to clarify longitudinal locations and interrelationships between the various elements of the coupling nut 1. In addition to the identified positions at either end of the bore 9, each individual element has a cable end 11 side and a connector end 13 side, i.e. the sides of the respective element that are facing the respective cable end 11 and the connector end 13 of the coupling nut 1.

Figure 10:
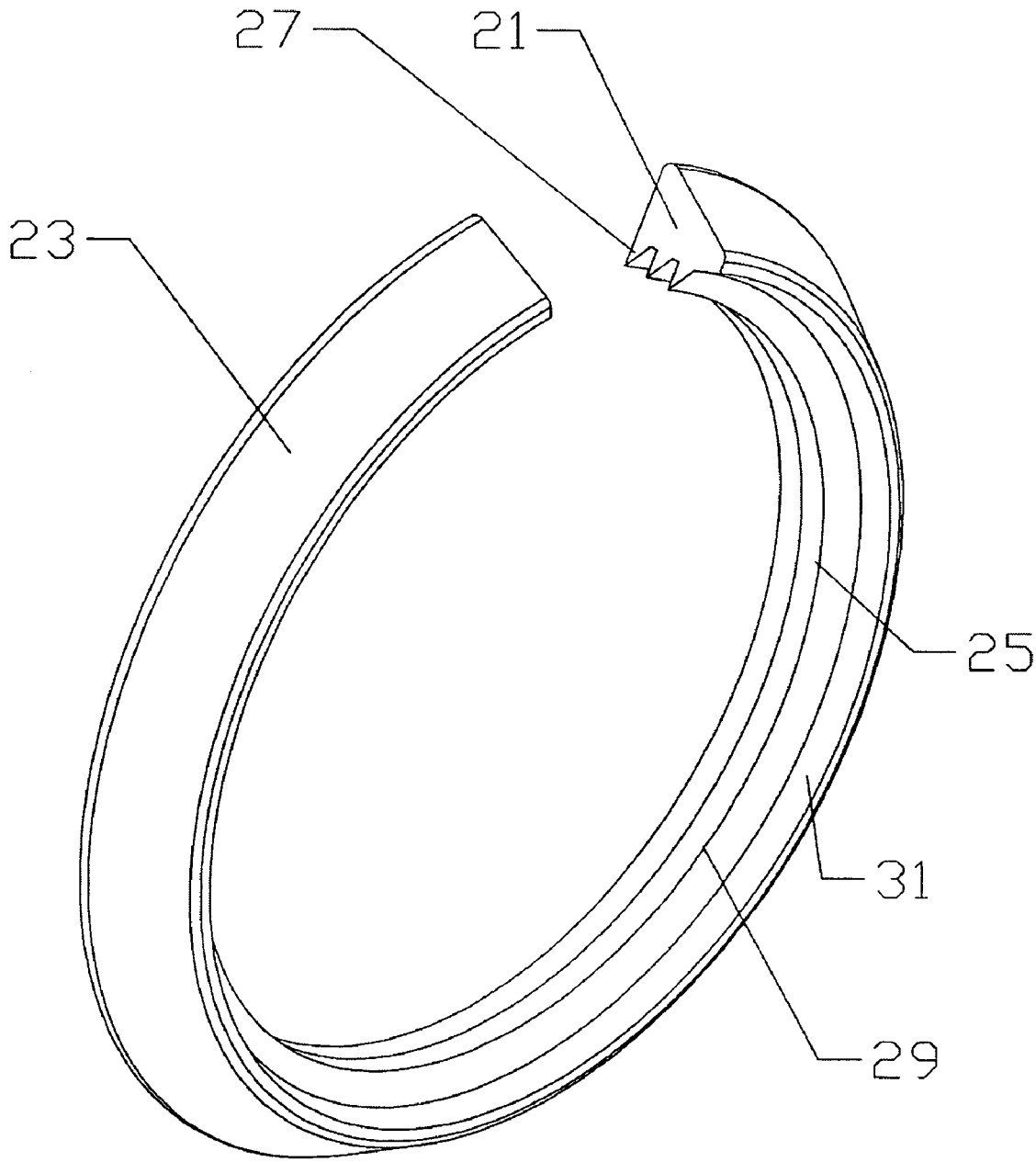
FIG. 10 is a schematic isometric view of a snap ring.

An annular wedge groove 15 is formed in the sidewall 17 proximate the cable end 11. An angled wedge surface 14 of the wedge groove 15, extending from the bore 9 sidewall 17 at a cable end 11 side to a bottom diameter 19 within the wedge groove 15, operates as a guide for a snap ring 21 retained in the wedge groove 15. As the snap ring 21 moves laterally toward the cable end 11 and engages the wedge surface 14, the snap ring 21 is redirected radially inward, toward the cable 5. To enhance the mechanical interaction between the snap ring 21 and the wedge surface 14, the snap ring 21 may be formed with an angled redirect surface 23 generally parallel and or otherwise complementary to the wedge surface 14, as best shown in FIG. 10. To prevent the snap ring 21 from binding within the wedge groove 15, prior to cable 5 insertion, the snap ring 21 may be formed with an outer diameter that is less than the bottom diameter 19.

An inner surface 25 of the snap ring 21 has a gripping feature 27, for example a plurality of annular barb(s) 29. The gripping feature 27 may be directional, for example configured to enable the jacket 3 to slide past the gripping feature 27 from the cable end 11 side towards the connector end 13 side, and to grip the jacket 3 during movement of the jacket 3 from the connector end 11 side towards the cable end 13 side. Where the gripping feature 27 is one or more annular barb(s) 29, the directional characteristic may be achieved by forming the annular barb(s) 29 with an angled surface on the cable end 11 side and a vertical surface on the connector end 13 side. The annular barbs may be formed in a helical thread configuration, enabling alternative removal of an attached coupling nut 1 via unthreading of the annular barb(s) 29 off of the jacket 3. A ramp surface 31 may be formed on the cable end 11 side of the snap ring 21, operative as a centering guide for the outer conductor 33 of the cable 5 during initial insertion through the snap ring 21. To minimize costs, the snap ring 21 may be manufactured from a polymeric material, for example via injection molding.

An inward projecting stop or shoulder 35 positioned at a connector end 11 side of the wedge groove 15 may be added as a stop for cable 5 insertion into the bore 9, positioning the cable 5 end laterally for proper engagement with the selected connector body during connector assembly. The inward projecting shoulder 35 may be dimensioned to project inward proximate an outer diameter of the outer conductor 33, thereby, the inward projecting shoulder 35 provides a centering function for the cable 5, maintaining the cable 5 coaxial with the coupling nut 1, during insertion until the cable end of the jacket 3 abuts the inward projecting shoulder 35. For ease of manufacture via a turning center, the inward projecting shoulder 35 may be formed as an annular shoulder.

The coupling nut 1 may be environmentally sealed by the addition of an annular gasket groove 37 preferably located in the sidewall 17 between the wedge groove 15 and the inward projecting shoulder 35. A gasket 39, such as an elastomeric o-ring, seated in the gasket groove 37, is dimensioned to seal against the jacket 3.

Figure 2:
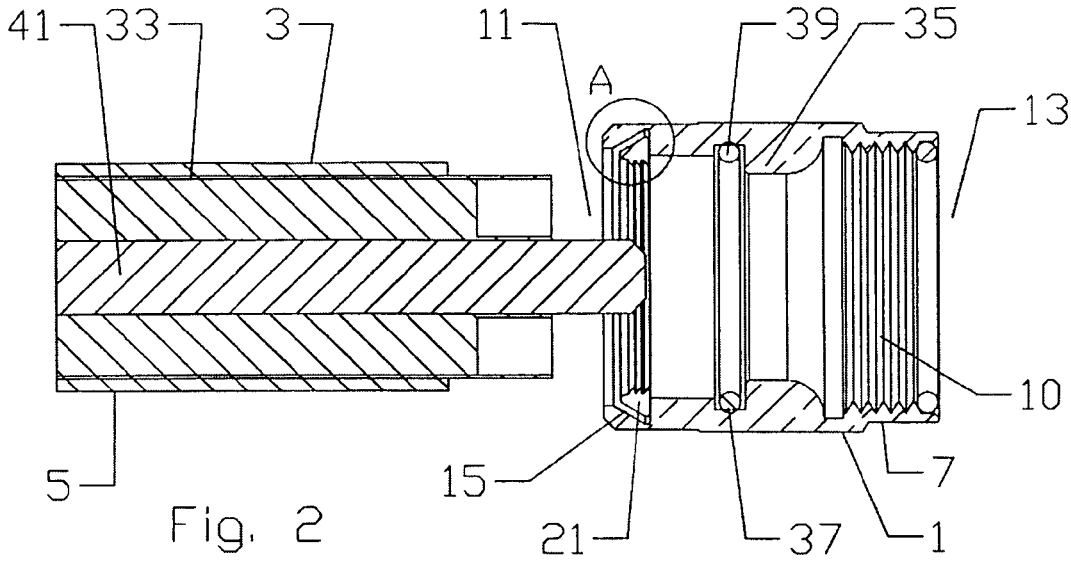
FIG. 2 is a schematic cross-section side view of a coaxial cable ready for insertion into the coupling nut of FIG. 1.
Figure 3:
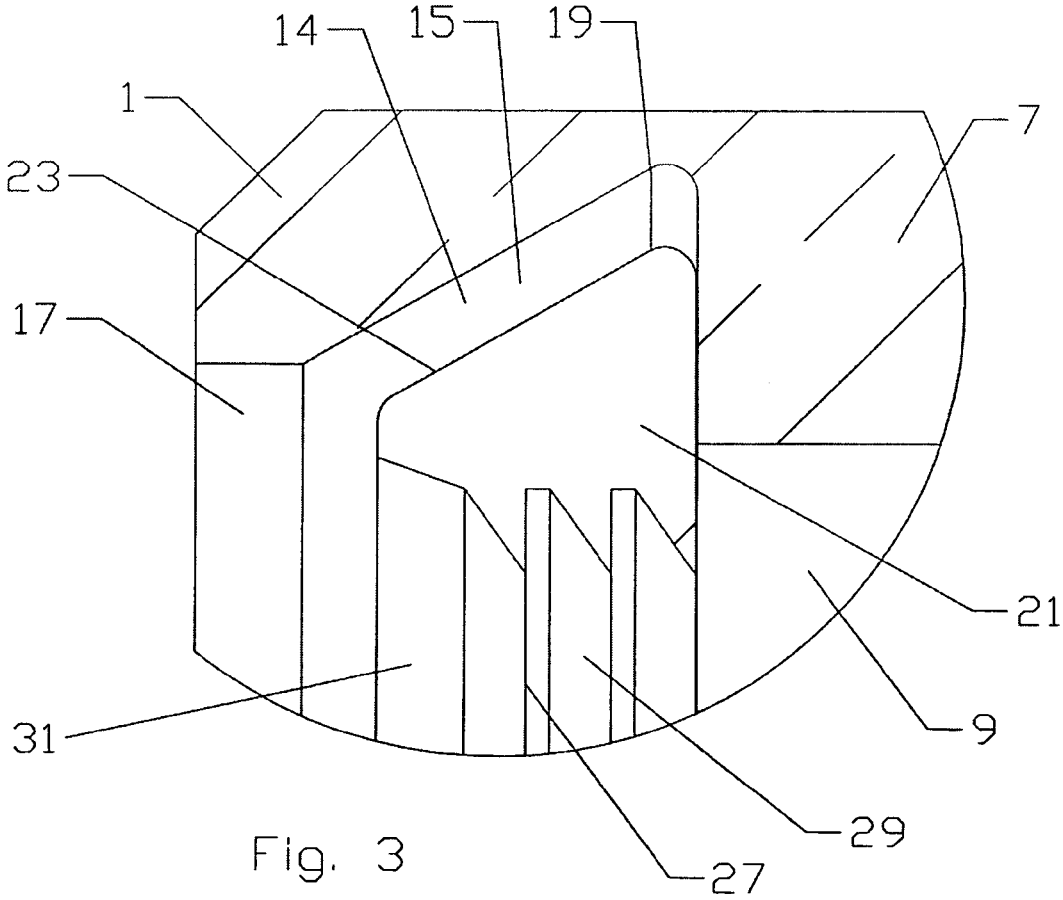
FIG. 3 is an enlarged close-up schematic cross-section side view of area A of FIG. 2.
Figure 4:
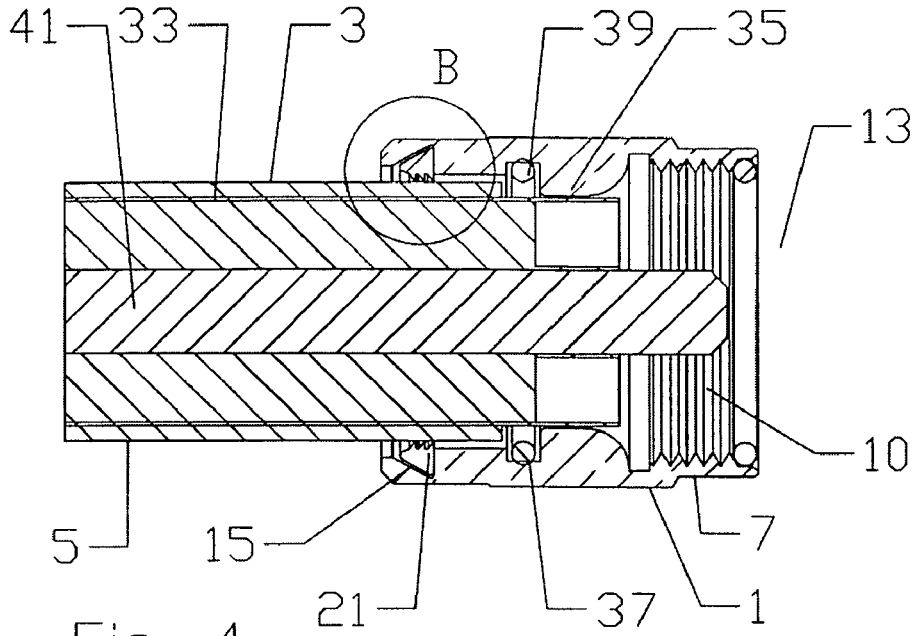
FIG. 4 is an enlarged schematic cross-section side view of a coaxial cable partially inserted into the coupling nut of FIG. 1.
Figure 5:
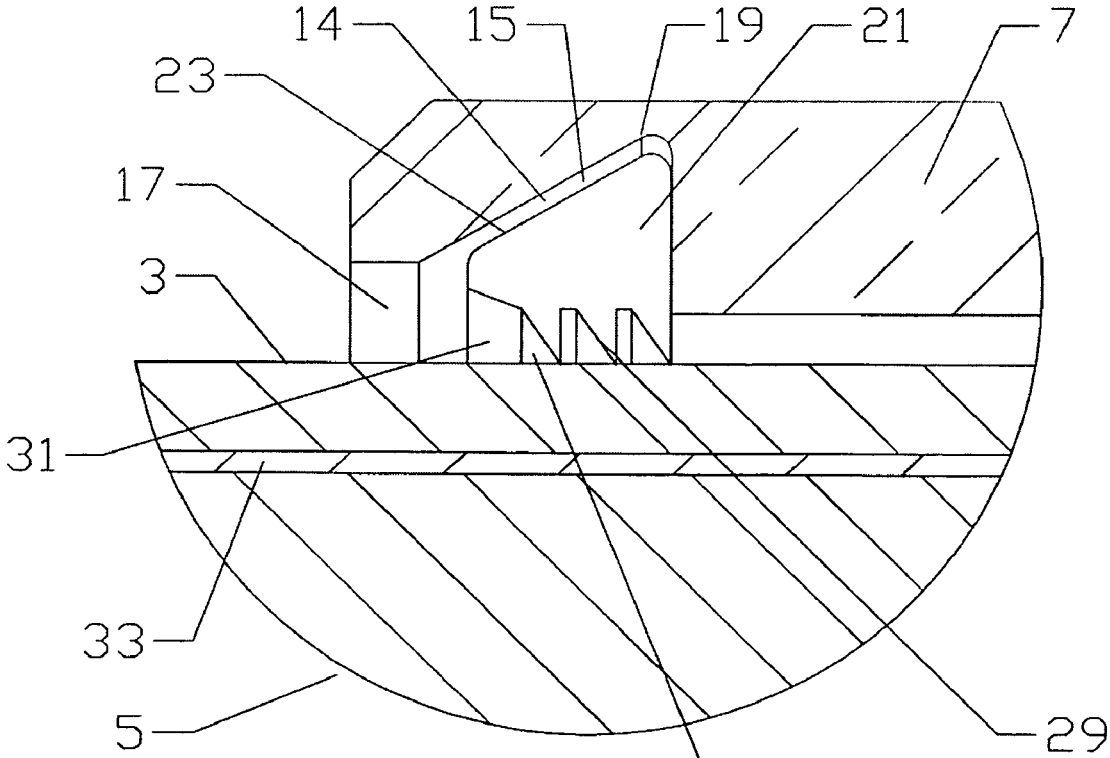
FIG. 5 is an enlarged close-up schematic cross-section side view of area B of FIG. 4.
Figure 6:
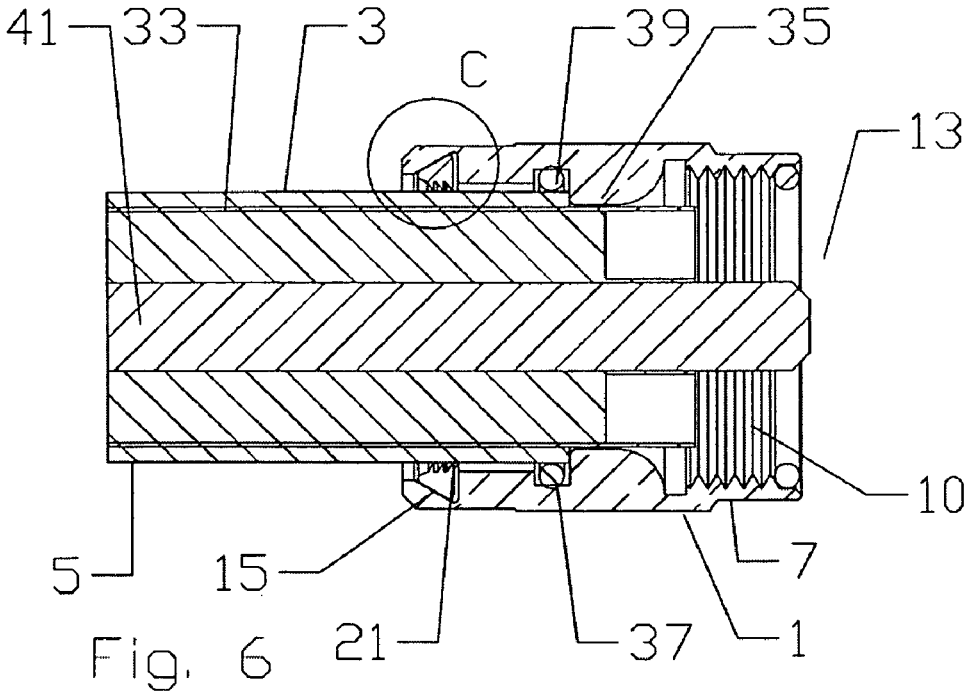
FIG. 6 is an enlarged schematic cross-section side view of a coaxial cable seated within the coupling nut of FIG. 1.
Figure 7:
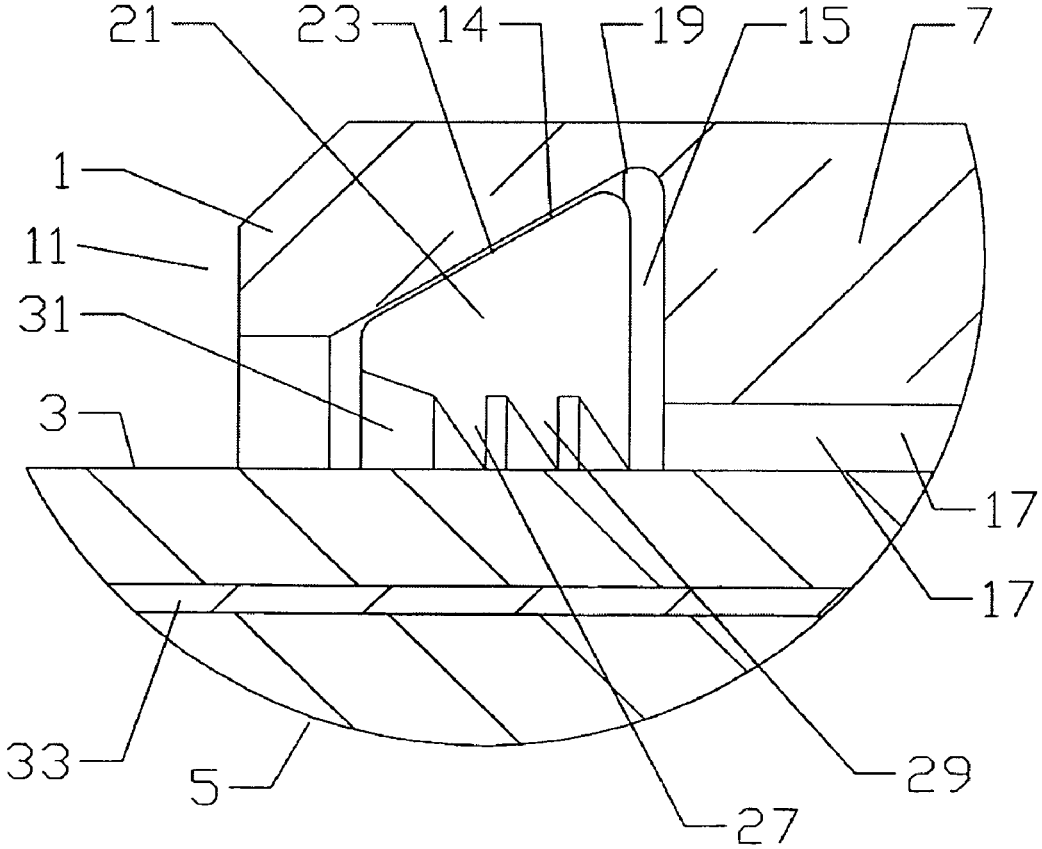
FIG. 7 is an enlarged close-up schematic cross-section side view of area C of FIG. 6.

In use, the cable end is stripped back to expose desired lengths of the inner conductor 41 and outer conductor 33 and inserted into the bore 9 of the coupling nut 1 at the cable end, as best shown in FIGS. 2 and 3. As the leading edge of the jacket 3 contacts the ramp surface 31 of the snap ring 21, the snap ring 21 is pushed toward a connector end 13 side of the wedge groove 15 and spread radially outward into the wedge groove 15, as best shown in FIGS. 4 and 5. When the cable 5 passes far enough into the bore 9, the jacket 3 abuts the inward projecting shoulder 35 as best shown in FIGS. 6 and 7. At this point, the snap ring 21 has a limited range of lateral movement within the wedge groove 15. The coupling nut 1 is laterally positioned on the cable end, ready to receive the connector body, the coupling nut 1 rotatable about the cable end, the snap ring 21 rotatable within the wedge groove 15.

Figure 8:
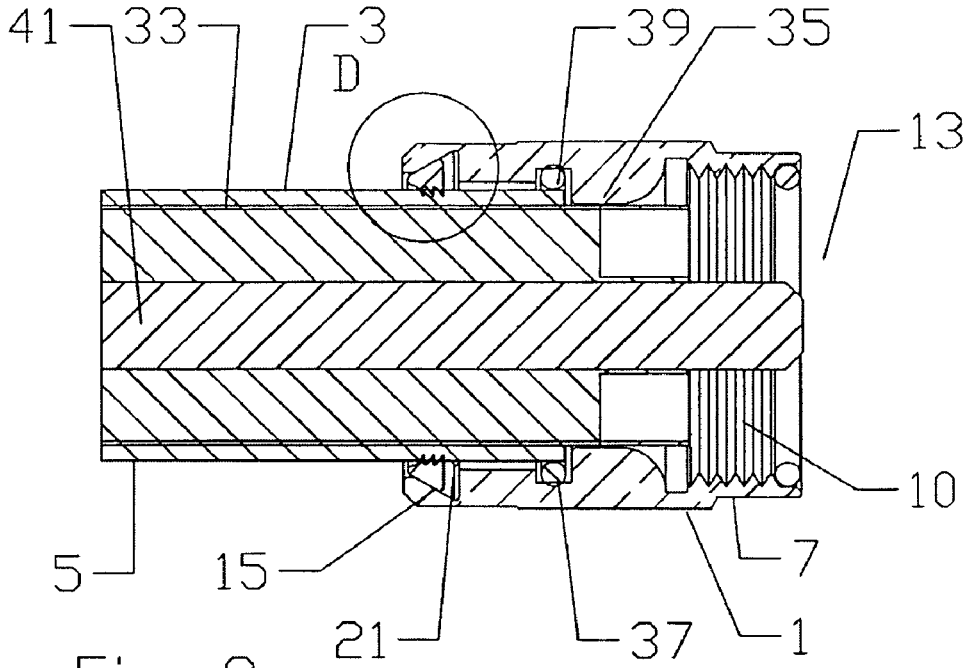
FIG. 8 is a schematic cross-section side view of a coaxial cable under withdrawal tension from the coupling nut of FIG. 1.
Figure 9:
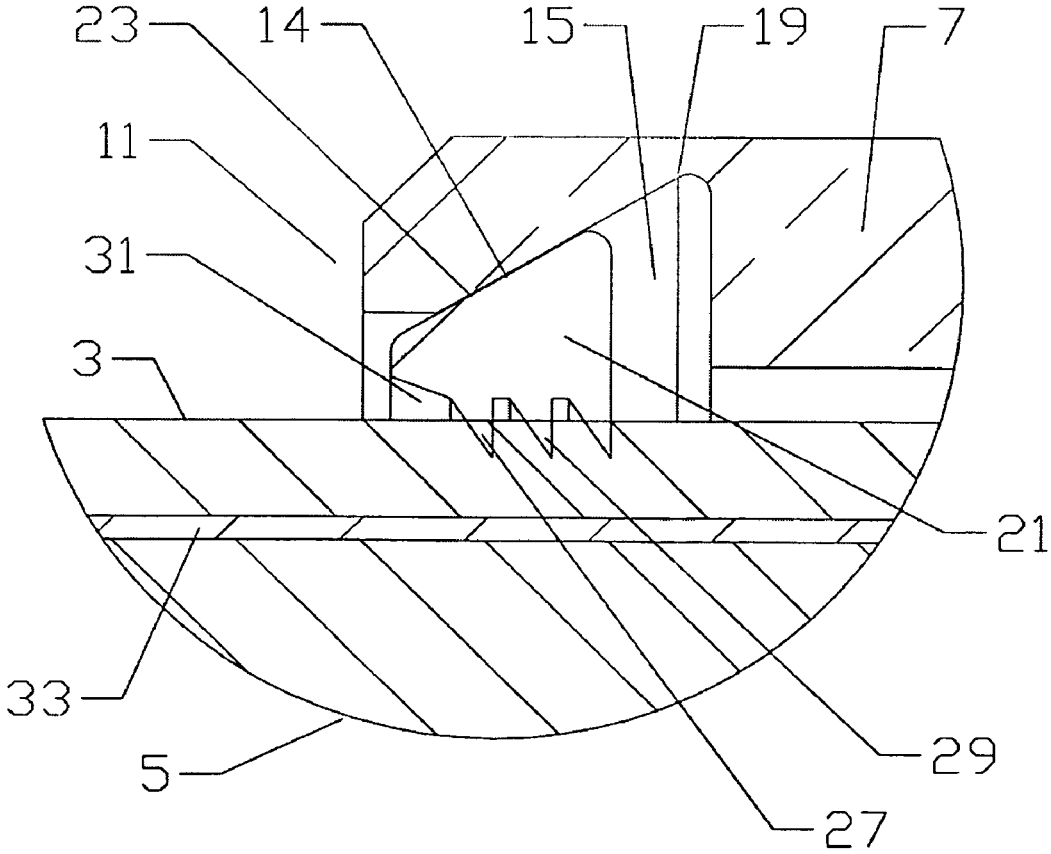
FIG. 9 is an enlarged close-up schematic cross-section side view of area D of FIG. 8.

When a push or pull force is applied to the cable 5 and or to the coupling nut 1, moving the cable 5 towards the cable end 11 side with respect to the coupling nut 1, the gripping feature 27 engages the jacket 3 and pulls the snap ring 21 into the wedge surface 14, which operates to drive the snap ring 21 radially inward into a progressively increasing secure centering contact with the jacket 3 thus preventing further cable 5 movement with respect to the coupling nut 1, as best shown in FIGS. 8 and 9.

Figure 11:
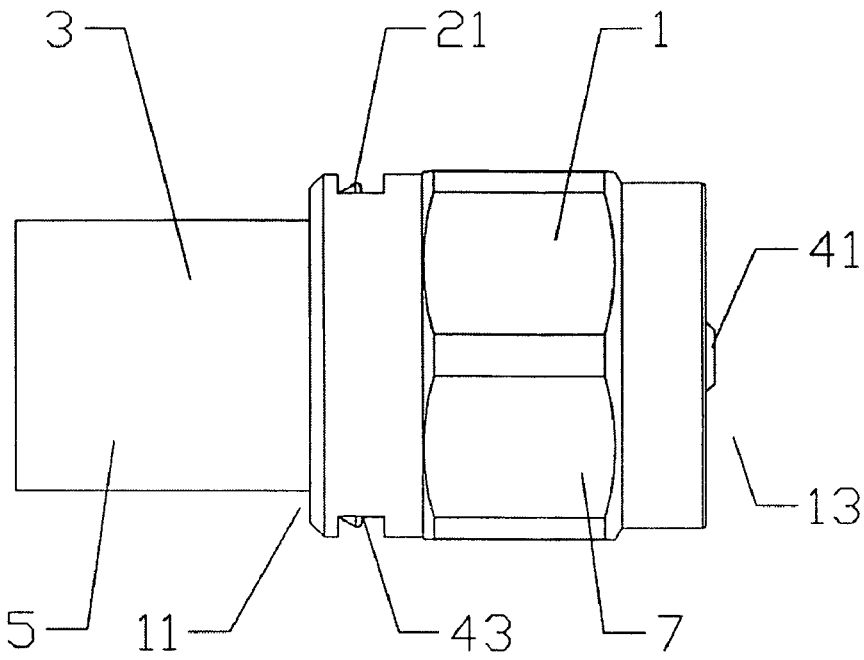
FIG. 11 is a schematic side view of a coupling nut with snap ring release apertures, mounted on a portion of cable.
Figure 12:
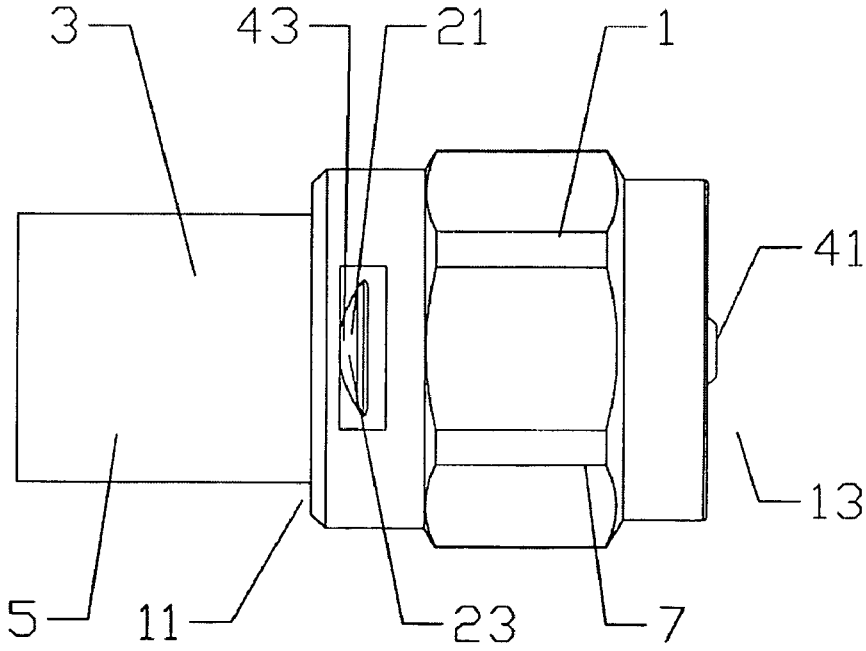
FIG. 12 is a schematic top view of a coupling nut with snap ring release apertures, mounted on a portion of cable.
Figure 13:
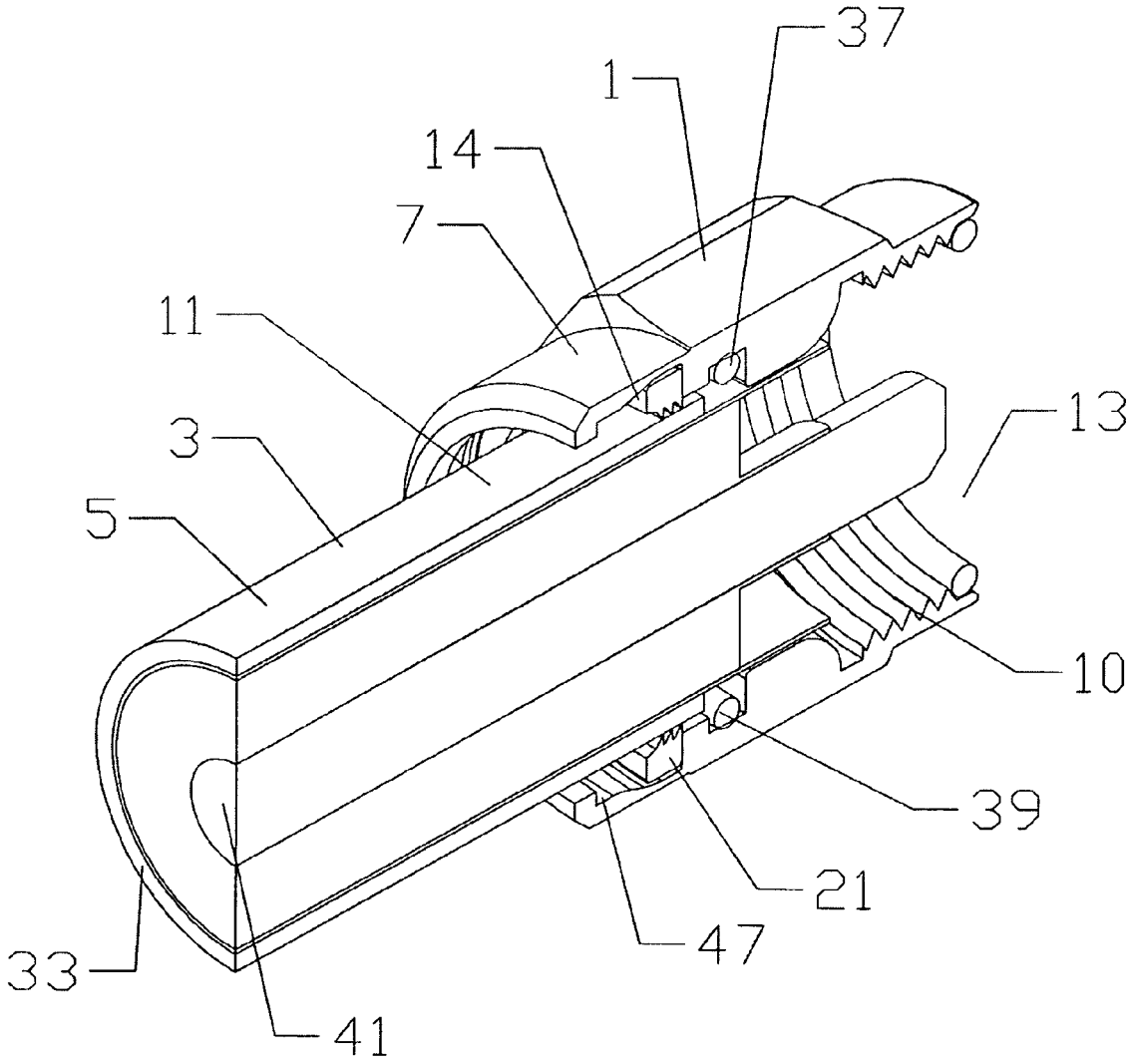
FIG. 13 is a schematic isometric rear cut-away view of an alternative exemplary embodiment of a coupling nut mounted on a portion of coaxial cable.

To release a coupling nut 1 from a cable 5, a shim may be inserted between the ramp surface 31 and the jacket 3, to drive the snap ring 21 towards the connector end 13 and radially outward, free of engagement with the jacket 3. Alternatively, the coupling nut 1 may be configured with aperture(s) 43 between the outer diameter of the coupling nut 1 and the wedge groove 15, for example as shown in FIGS. 1, 11 and 12. The aperture(s) 43 may be formed as slots that intersect with the wedge groove 15. Pushing the snap ring 21 towards the connector end 13 side of the wedge groove 15 via the aperture (s) 43 disengages the snap ring 21 from the wedge surface 14 and thereby the snap ring 21 from the jacket 3, enabling withdrawal of the cable 5 from the coupling nut 1.

In an alternative embodiment, as shown in FIGS. 13-21, the wedge groove 15 may be formed with an insertion seat 45 at the bottom diameter 19 and a retaining seat 47 at the cable end 11 side of the wedge surface 14. The snap ring 21 is provided with an outer diameter surface complementary to the insertion seat 45 and the retaining seat 47. The redirect surface 23 of the snap ring 21, may be formed as a rounded edge.

Figure 14:
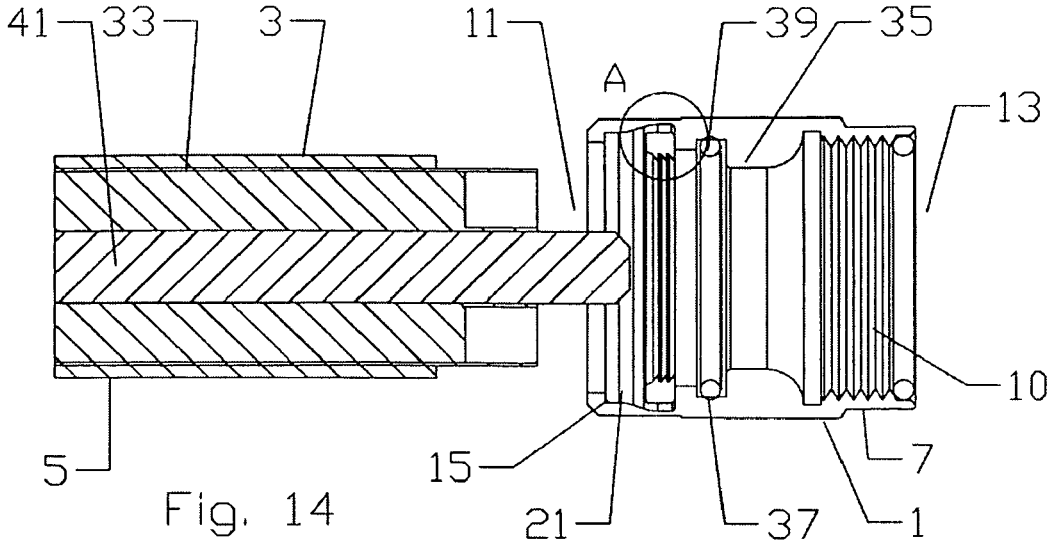
FIG. 14 is a schematic cross-section side view of a coaxial cable ready for insertion into the coupling nut of FIG. 13.
Figure 15:
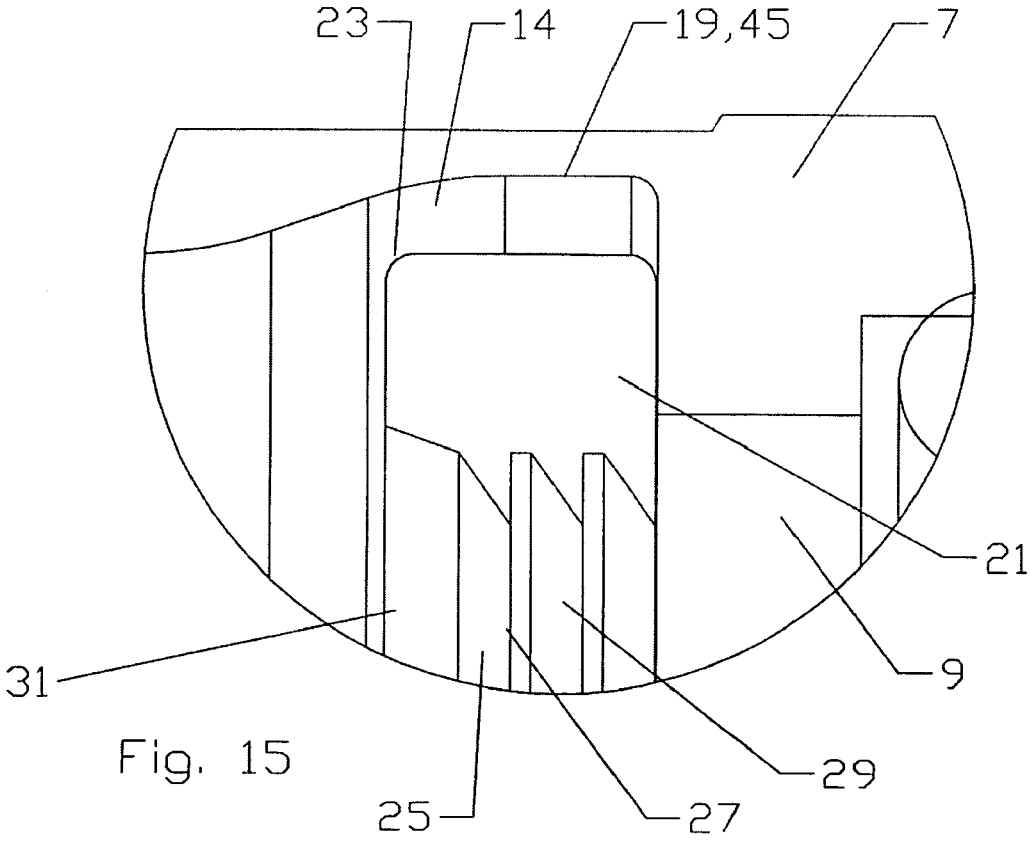
FIG. 15 is an enlarged close-up schematic cross-section side view of area A of FIG. 14.
Figure 16:
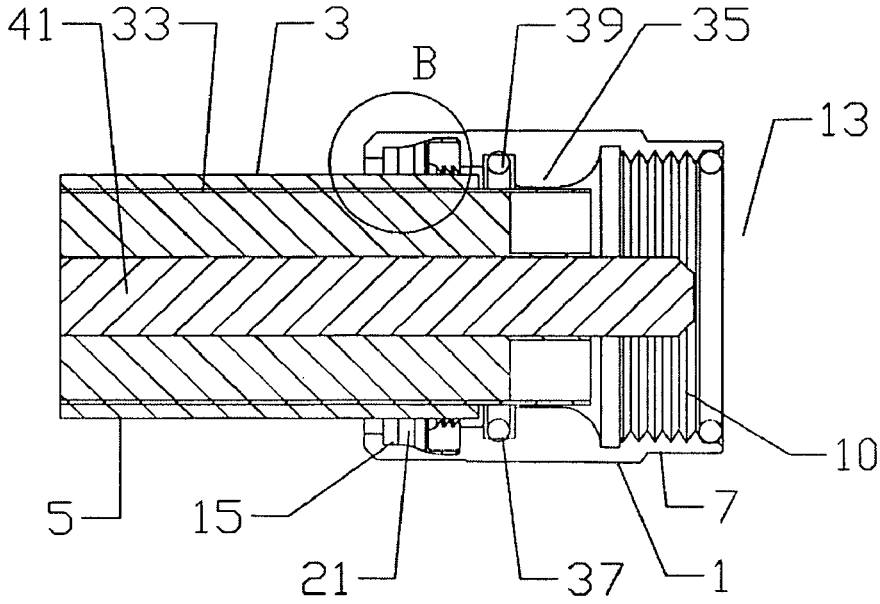
FIG. 16 is an enlarged schematic cross-section side view of a coaxial cable partially inserted into the coupling nut of FIG. 13.
Figure 17:
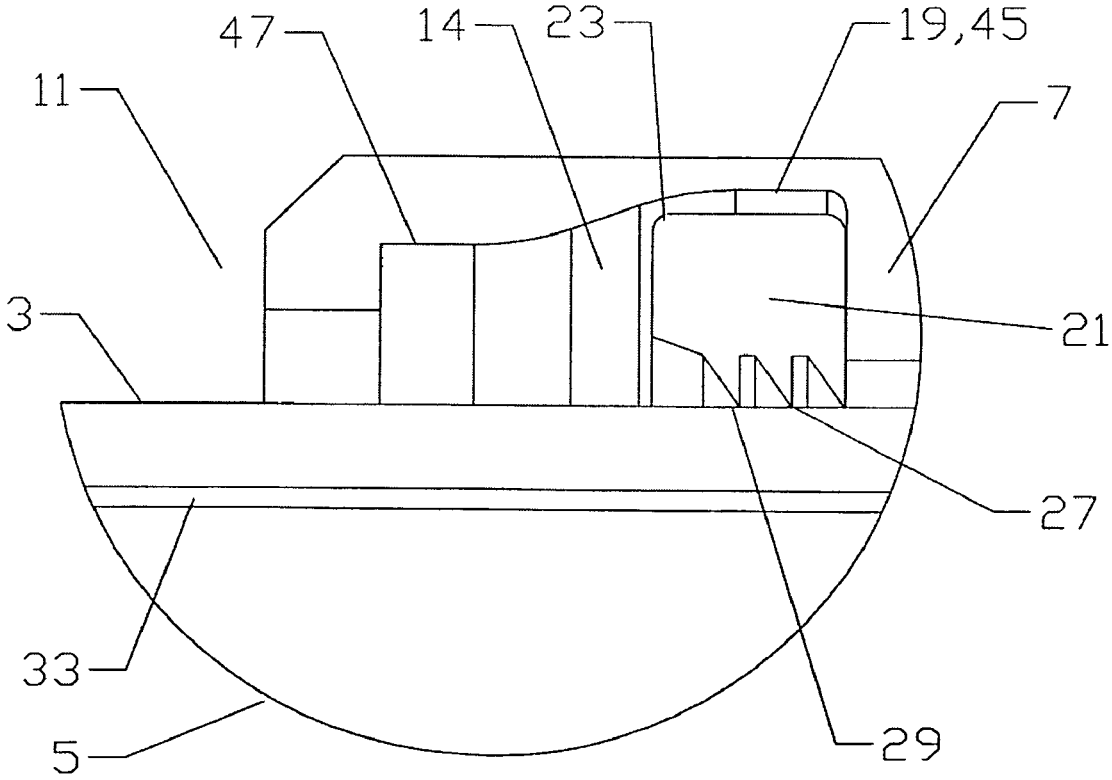
FIG. 17 is an enlarged close-up schematic cross-section side view of area B of FIG. 16.
Figure 18:
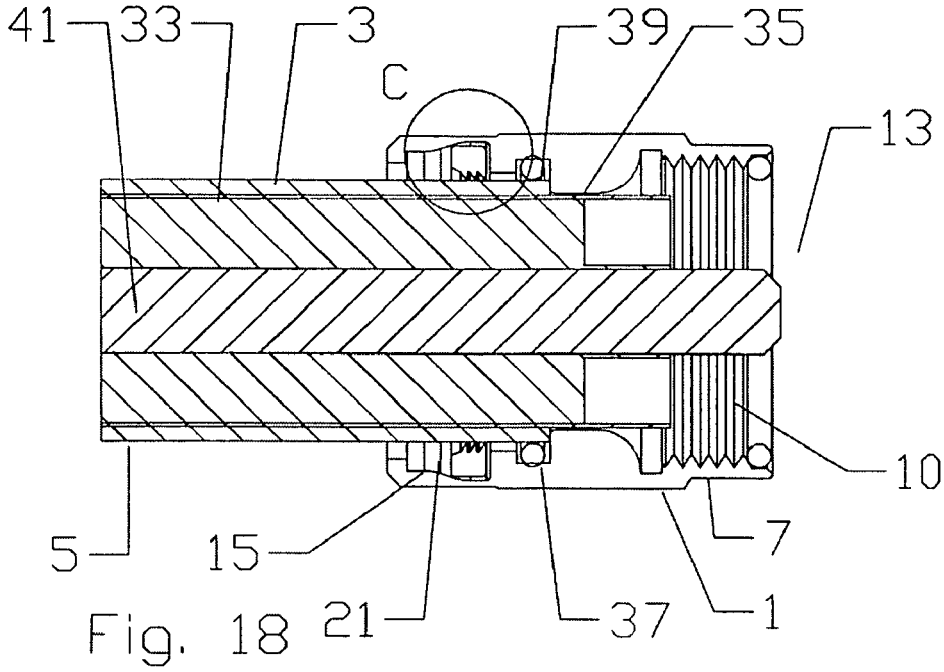
FIG. 18 is an enlarged schematic cross-section side view of a coaxial cable seated within the coupling nut of FIG. 13.
Figure 19:
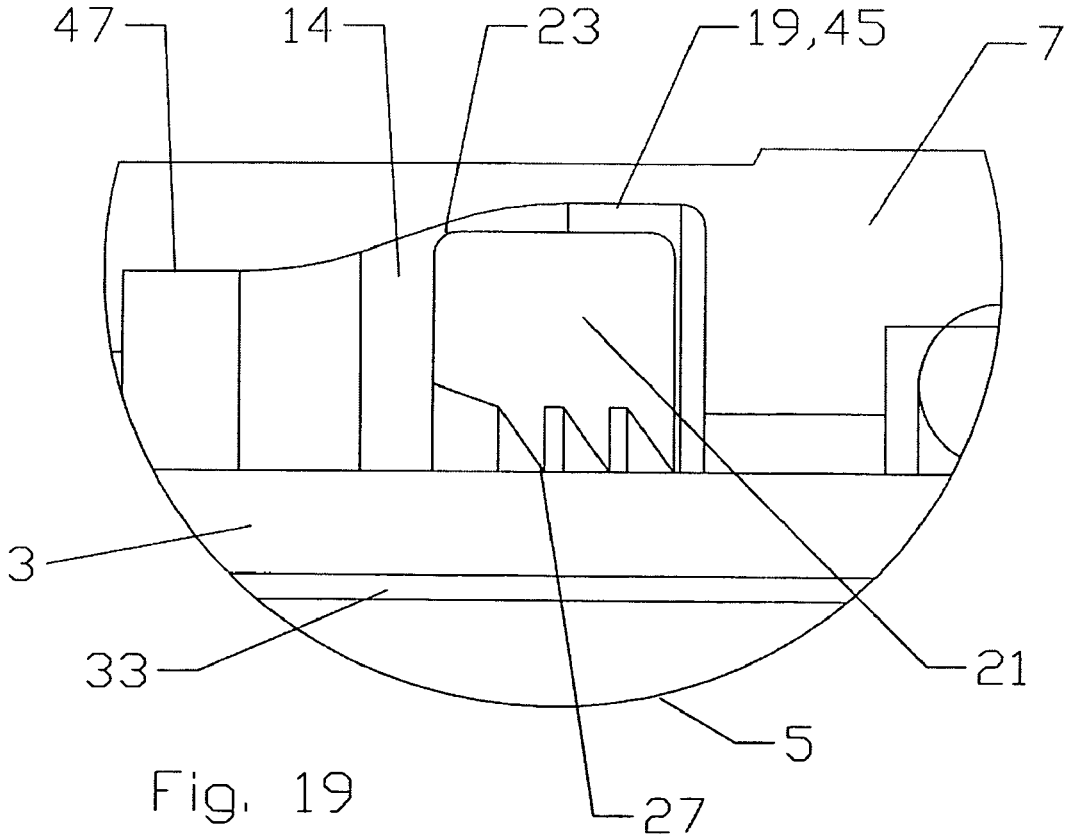
FIG. 19 is an enlarged close-up schematic cross-section side view of area C of FIG. 18.

As shown in FIGS. 14 and 15, the insertion seat 45 provides a space for the snap ring 21 prior to cable 5 insertion. During cable 5 insertion (FIGS. 16 and 17), the snap ring 21 spreads further into the insertion seat 45, enabling the snap ring 21 to spread and pass over the jacket 3.

Figure 20:
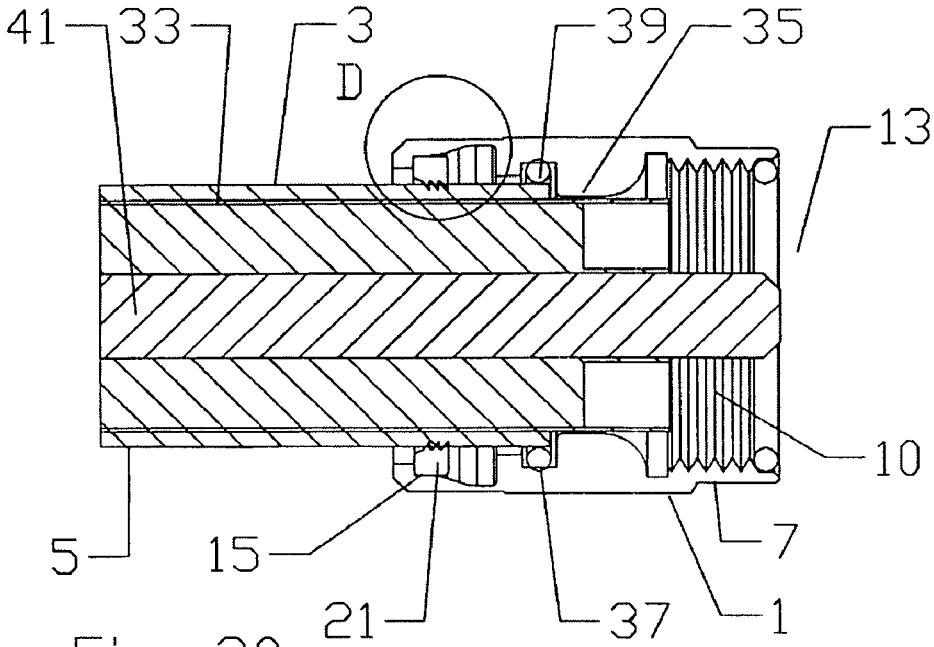
FIG. 20 is a schematic cross-section side view of a coaxial cable under withdrawal tension from the coupling nut of FIG. 13.
Figure 21:
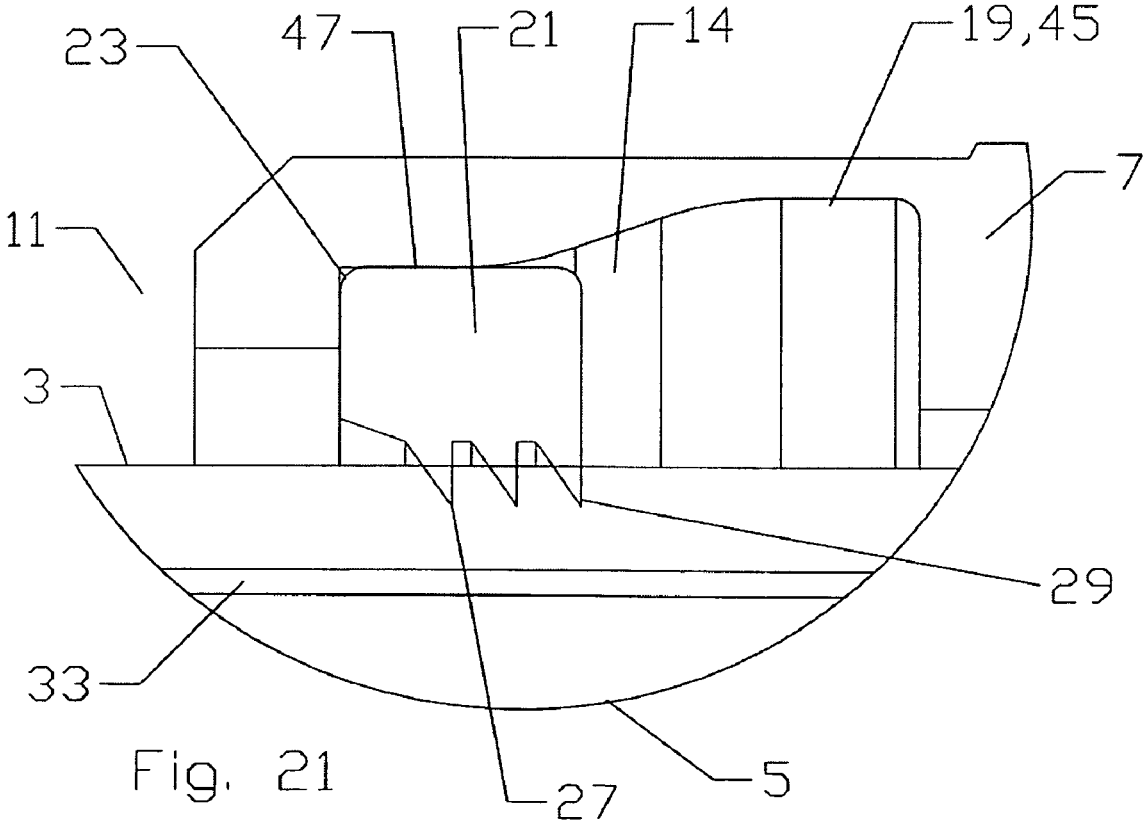
FIG. 21 is an enlarged close-up schematic cross-section side view of area D of FIG. 20.

When a push or pull force is applied to the cable 5 and or to the coupling nut 1, moving the cable 5 towards the cable end 11 side with respect to the coupling nut 1, the gripping feature 27 engages the jacket 3 and pulls the snap ring 21, stabilized by the insertion seat 45, into the wedge surface 14 (FIGS. 18 and 19), which operates to drive the snap ring 21 radially inward into a progressively increasing secure centering contact with the jacket 3 until the snap ring 21 finally seats within the retaining seat 47, held against the cable 5, as best shown in FIGS. 20 and 21.

Although application of the retaining seat 47 increases a length requirement of the coupling nut 1, the retaining seat 47 increases the stability of the coupling nut 1 upon the cable 5 compared to the first embodiment, as engagement between the wedge surface 14 and the snap ring 21 in the installed position that biases the coupling nut 1 to move towards the cable end 11 side with respect to the snap ring 21 is eliminated.

One skilled in the art will appreciate the several improvements realized via the present invention. The coupling nut 1 is usable with a wide range of different cable(s) 5 having jacket (s) 3 of varying thickness and or surface characteristics. Because the coupling nut 1 is rotatable with respect to the cable 5 during connector assembly, generation of metal shavings at the inner conductor spring basket and or other degradation of the inner conductor 41 from rotation of the spring basket about the inner conductor 41 is eliminated. The prior complex internal jacket thread machining operations are eliminated. The prior threaded mounting operation between the jacket 3 and the coupling nut 1 is eliminated. The space available for the gasket 39 is increased and a travel distance of the gasket 39 across the jacket 3 is reduced, enabling use of a wider gasket 39 with greater contact area against the jacket 3, improving the environmental seal. The cable 5 is held more securely with respect to the coupling nut 1, improving the cable 5 to connector interconnection strength. The cable 5 is supported coaxially within the coupling nut 1 at two spaced apart points, reducing the opportunity for the cable to shift and generate IMD. Further, the compact but more securely supported configuration enables compact angled connector configurations, such as right angle connectors, panel mount connectors and the like. Finally, installation is greatly simplified, eliminating the previous need for tools to grip the coupling nut 1 for threading upon the jacket 3.

Table of Parts

| | |
|---|---|
| 1 | coupling nut |
| 3 | jacket |
| 5 | cable |
| 7 | body |
| 9 | bore |
| 10 | thread |
| 11 | cable end |
| 13 | connector end |
| 14 | wedge surface |
| 15 | wedge groove |
| 17 | side wall |
| 19 | bottom diameter |
| 21 | snap ring |
| 23 | redirect surface |
| 25 | inner surface |
| 27 | gripping feature |
| 29 | annular barb |
| 31 | ramp surface |
| 33 | outer conductor |
| 35 | shoulder |
| 37 | gasket groove |
| 39 | gasket |
| 41 | inner conductor |
| 43 | aperture |
| 45 | insertion seat |
| 47 | retaining seat |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coupling nut for an electrical connector connectable to an electrical cable having an outer conductor surrounded by a jacket, comprising:

a monolithic cylindrical body with a bore extending between a cable end and a connector end;

an annular wedge groove;

an angled wedge surface in a sidewall of the bore proximate the cable end extending from the bore sidewall at a cable end side to a bottom diameter within the wedge groove;

a snap ring retained in the wedge groove; and an inner surface of the snap ring provided with a gripping feature.

2. The coupling nut of claim 1, further including a radially inward projecting shoulder positioned at a connector end side of the wedge groove.

3. The coupling nut of claim 2, wherein the inward projecting shoulder projects inward proximate an outer diameter of the outer conductor.

4. The coupling nut of claim 2, further including an annular gasket groove in the bore sidewall between the wedge groove and the inward projecting shoulder.

5. The coupling nut of claim 4, further including a gasket seated in the gasket groove; the gasket dimensioned to seal against the jacket.

6. The coupling nut of claim 1, wherein the snap ring has a radially outer angled surface parallel to the wedge surface.

7. The coupling nut of claim 1, wherein the gripping feature is dimensioned to enable the jacket to slide past the gripping feature from the cable end towards the connector end, and to grip the jacket during movement of the jacket from the connector end towards the cable end.

8. The coupling nut of claim 1, wherein the gripping feature is a plurality of annular barbs.

9. The coupling nut of claim 8, wherein the annular barbs are angled to pass over the jacket as the jacket is inserted into the bore from the cable end and to grip the jacket as it is removed towards the cable end.

10. The coupling nut of claim 8, wherein the annular barbs are formed as a helical thread.

11. The coupling nut of claim 1, further including at least one aperture between the outer surface of the coupling nut 1 and the wedge groove.

12. The coupling nut of claim 1, further including a thread in the bore sidewall at the connector end.

13. The coupling nut of claim 1, wherein the snap ring has an outer diameter annular ramp surface at a cable end side.

14. The coupling nut of claim 1, wherein the bottom diameter is greater than an outer diameter of the snap ring.

15. The coupling nut of claim 1, further including an insertion seat at the bottom diameter.

16. The coupling nut of claim 1, further including a retaining seat at a cable end side of the angled wedge surface.

17. A coupling nut for an electrical connector connectable to an electrical cable having an outer conductor surrounded by a jacket, comprising:

a monolithic cylindrical body with a bore extending between a cable end and a connector end;

an annular wedge groove in the bore sidewall proximate the cable end;

an angled wedge surface of the wedge groove extending from the bore sidewall at a cable end side to a bottom diameter within the wedge groove;

a snap ring retained in the wedge groove;

the snap ring has an outer angled surface parallel to the wedge surface;

an inner surface of the snap ring provided with a plurality of annular barbs;

an annular inward projecting shoulder positioned at a connector end side of the wedge groove, projecting inward proximate an outer diameter of the outer conductor;

an annular gasket groove in the bore sidewall between the wedge groove and the inward projecting shoulder; and a gasket seated in the gasket groove; the gasket dimensioned to seal against the jacket.

18. A coupling nut for an electrical connector connectable to an electrical cable having an outer conductor surrounded by a jacket, comprising:

a monolithic cylindrical body with a bore extending between a cable end and a connector end;

an annular wedge groove in a sidewall of the bore; the wedge groove provided with an angled wedge surface proximate the cable end extending from a retaining seat at a cable end side to an insertion seat at a bottom diameter;

a snap ring retained in the wedge groove; and an inner surface of the snap ring provided with a gripping feature.

19. The coupling nut of claim 18, wherein the retaining seat and snap ring are dimensioned such that the gripping feature of the snap ring engages the jacket when the snap ring is seated in the retaining seat.

20. The coupling nut of claim 18, wherein the snap ring has an outer surface parallel to the retaining seat.

* * * * *